United States Patent [19]

Dubren et al.

[11] Patent Number: 4,601,473

[45] Date of Patent: Jul. 22, 1986

[54] WORD FORMING GAME

[76] Inventors: Ronald D. Dubren; Patricia C. Dubren, both of 159 Second Ave., New York, N.Y. 10003

[21] Appl. No.: 656,141

[22] Filed: Sep. 28, 1984

[51] Int. Cl.[4] ..... A63F 3/00

[52] U.S. Cl. ..... 273/272

[58] Field of Search ..... 273/272, 299

[56] References Cited

U.S. PATENT DOCUMENTS

| | | | |
|---|---|---|---|
| 3,427,028 | 2/1969 | Abrahamsen | 273/272 |
| 3,797,829 | 3/1974 | Heller | 273/272 X |
| 3,930,651 | 1/1976 | Rader | 273/272 X |
| 4,082,279 | 4/1978 | McFadden | 273/272 |
| 4,448,423 | 5/1984 | Augusta | 273/272 |

FOREIGN PATENT DOCUMENTS

| | | | |
|---|---|---|---|
| 259924 | 11/1927 | United Kingdom | 273/156 |

*Primary Examiner*—Harland S. Skogquist

*Attorney, Agent, or Firm*—Lieberman, Rudolph & Nowak

[57] ABSTRACT

A word forming game in which words are formed from selected letters in a letter array. Word formation is accomplished through use of game pieces to designate the letters being selected to form a particular word. The game pieces are able to indicate multiple states or conditions with each state or condition being associated with a particular game player. During word formation letters previously used by an opposing player can be captured for use in forming new words.

10 Claims, 8 Drawing Figures

WORD FORMING GAME

FIELD OF THE INVENTION

This invention relates to word games and in particular to a unique word forming game in which one can "capture", for one's own use, the letters used by an opponent for word formation.

BACKGROUND OF THE INVENTION

Games in which opposing players compete to form words from individual letters are very old and indeed have probably existed as long as there has been written language. No doubt there have been, and will continue to be, innumerable variations to such games, but all such word games share several common characteristics: (1) a pool of available letters from which to form words, (2) a set of rules to govern word formation and (3) a method for identifying which particular player has formed the most words during a particular interval so that a game winner can eventually be declared.

An example of one type of word game is illustrated in U.S. Pat. No. 810,631 granted to S. F. Evos on Jan. 23, 1906. In this game, a board is used which is divided into adjacent spaces of different colors. Nine rows of spaces are provided, each row containing seventeen white and red spaces arranged alternately. Two distinguishable sets of game pieces are employed, each game piece bearing one letter with no two pieces having the same letter. In play, the game pieces are arranged alphabetically upon predetermined board rows and moved one space at a time in any direction until adjacent game pieces can be used to form words of three or more letters. Each player completing a word has the privilege of removing an opponents piece from the board with specific removal rules applying for vowles and consonants. The game ends when one player has lost sixteen pieces.

Another word formation game is illustrated in U.S. Pat. No. 3,016,243 granted to William R. Irwin on June 6, 1962. This game employs a set of playing cards, each having certain areas which are opaque and other areas which are transparent. The opaque areas of the playing cards are provided with displays, such as letters. In play, the cards are drawn from a deck and placed on a playing surface having a pattern corresponding to that of the spacing of the opaque and transparent areas on the cards. The cards are then superimposed, one card over another, or over the playing surface, to form words. Scoring is accomplished by counting the number of words formed or the number of letters used in word formation.

Examples of other games using both letters and numbers can be found in U.S. Pat. Nos. 1,613,204, 1,764,448, 2,585,458, 4,131,282 and 4,346,889.

Notwithstanding the wide variety of known word games, the search has continued for an exciting and challenging word game that requires skill and intelligence yet is still "fun" to play.

It is, therefore, an object of the instant invention to provide a word game that requires skill and strategy yet is relatively simple to learn.

It is another object of the instant invention to provide a word game that requires only simple and inexpensive apparatus for playing the game.

It is a further object of the instant invention to provide a word game in which the letter pool is chosen to provide for formation of a large number of possible words, thus creating an exciting and challenging word game.

It is a still further object of the instant invention to provide a word game in which the number of letters from words formed by each opposing player is readily apparent from a visual inspection of the playing surface.

It is another object of the instant invention to provide a word game in which letters an opponent has used in word formation can be commandeered for use by a challenging player, thus imparting a high level of excitement and skill to the game.

SUMMARY OF THE INVENTION

In accordance with one aspect and feature of the invention, a word forming game is provided in which words are formed from a plurality of available letters in a leter pool.

It is a feature of the invention that a letter array is formed from the letters in the letter pool and letter designators are used to form words from the individual letters in the selected array.

It is a further feature of the invention that the letter designators have multiple states or conditions that are visible to all game players with a particular state or condition being assigned to each game player.

It is still another feature of the invention that letter capture is possible during word formation wherein a state or condition of a letter designator is changed from association with a first player to association with a second player.

In accordance with a first embodiment of the invention a letter array is formed from a plurality of letter tiles in a letter tile pool, each tile bearing a predetermined number of letters, and words are formed by placing dual-colored rings over selected letters on said letter tiles, each of said dual colors being assigned to a particular game player.

In accordance with a second embodiment of the invention, word formation is accomplished with a letter pool formed from a plurality of multiple-sided die with the same letter being visible on each die face and different colors on each of said die faces being assigned to different game players.

It is a still further feature of the invention that the letters in the letter pool are specifically chosen to enhance word formation both in terms of letter frequency and letter position in the letter array.

These and other objects and features of the invention will be more fully appreciated from the following detailed description when taken in conjunction with the following drawings in which:

DETAILED DESCRIPTION

The instant invention is directed generally to a word game in which opposing players form words from an array of available letters with the player utilizing the most available leters being victorious. Many embodiments of the instant invention are possible, but the essential mechanism of each embodiment is the "capture" of letters previously used by an opposing player with a multiple state, or condition, game piece. By "capturing" an opposing player's letters during word formation, one not only creates words which count toward winning, but reduces or eliminates an opponents chances of creating his or her own words. Also, the use of a multiple state or condition game piece to accomplish "capture" when each state is associated with a particular player, allows each player to readily ascertain the state of the game, i.e., who is winning and who is losing. It is understood that "capture", as defined herein, means utilization of letters, already used by an opponent, in forming one's own words during the game.

Two embodiments of the invention shall be described. It is understood, however, that limiting this detailed description to two embodiments is not intended to be restrictive of the scope of the invention which can be embodied in a variety of methods and game playing equipment.

Figure 1:
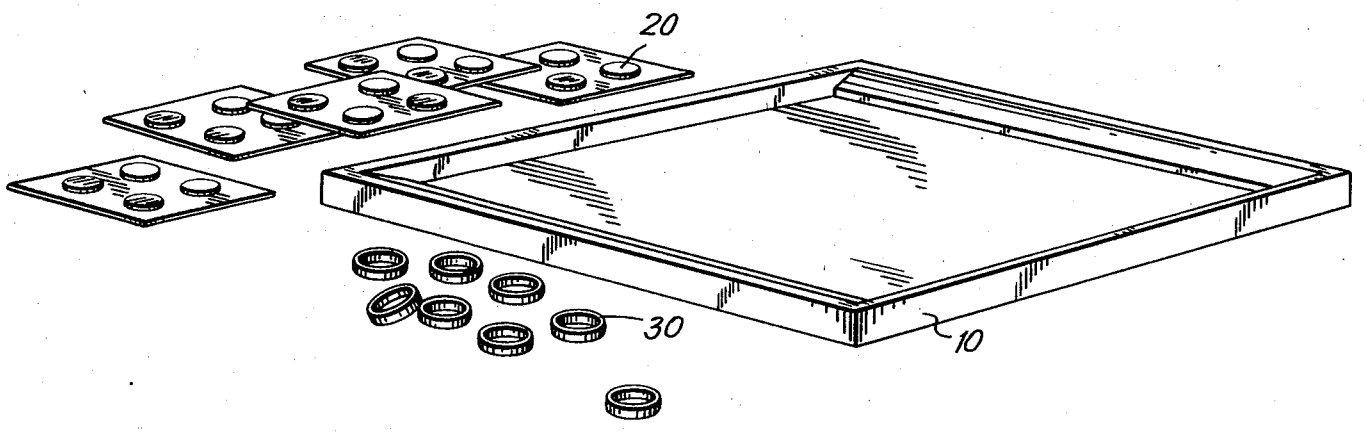
FIG. 1 illustrates the game tray, playing rings and letter tiles necessary for use with a first embodiment of the invention.

Referring now to FIG. 1 there is shown respectively the game tray 10, letter tiles 20, and playing rings 30 for use with a first embodiment of the invention. Game tray 10 consists of a flat playing surface surrounded by upstanding rails to form a recessed container for letter tiles 20. The size of the game tray is not critical and can accomodate comfortable playing for adults and children. Letter tiles 20 are square in shape and contain four letters raised on a circular surface. The size of the letter tiles for this embodiment of the invention is such that nine letter tiles will fit within the letter tray. Although the letter tiles as shown only have letters on one side, it is understood that the letter tiles could have letters on both sides.

Figure 7:
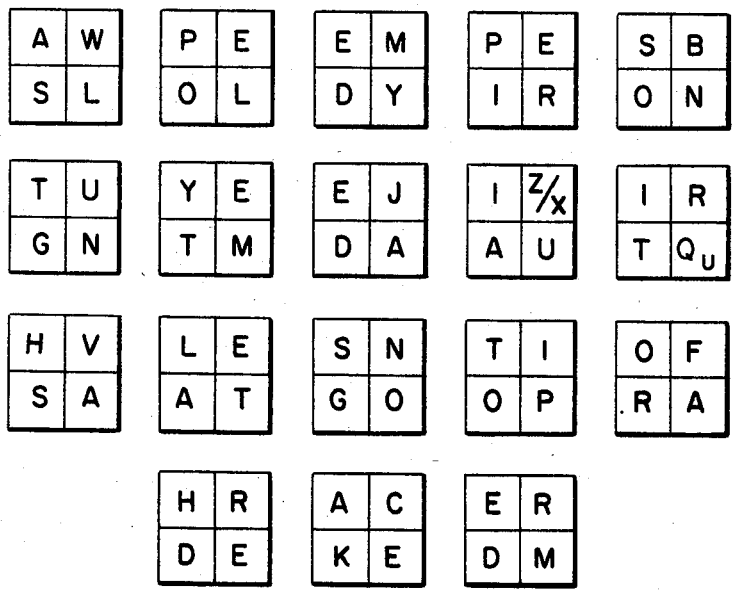
FIG. 7 illustrates the distribution of letters or letter tiles with a first embodiment of the invention.

In order to enhance the production of useable words from the array of letter tiles, when placed within the game tray, care was taken to particularly group the letters on the tiles. First note from FIG. 1 that the letter tiles can be oriented in any of four directions so that a very large number of different arrays can be generated and also each letter tile can be placed in four ways at any one of nine different locations in the game tray. In addition, the letter frequency has been selected to correspond approximately to the distribution of letters in the English language. Finally, the distribution of four letters on each letter tile was done in such a way so as not to duplicate any letter and to create a mix of vowles and consonants (vowels being critical to word formation). Experimentation with game playing has resulted in the following preferred letter distribution:

Nine E's
Seven A's
Five Each of O, R, & T
Four Each of D, I, & S
Three Each of L, M, N, & P
Two Each of G, H, U, & Y
One Each of B, C, F, J, K, Q, V, W, X, & Z A preferred letter distribution is shown in FIG. 7.

Playing ring 30 in FIG. 1 consists of a ring sized to fit over the raised circular surface on each of the letters shown on the letter tiles. In this embodiment of the invention one side of the ring is blue while the other side of the ring is red, thereby creating a multiple state or condition game playing piece.

Figure 2:
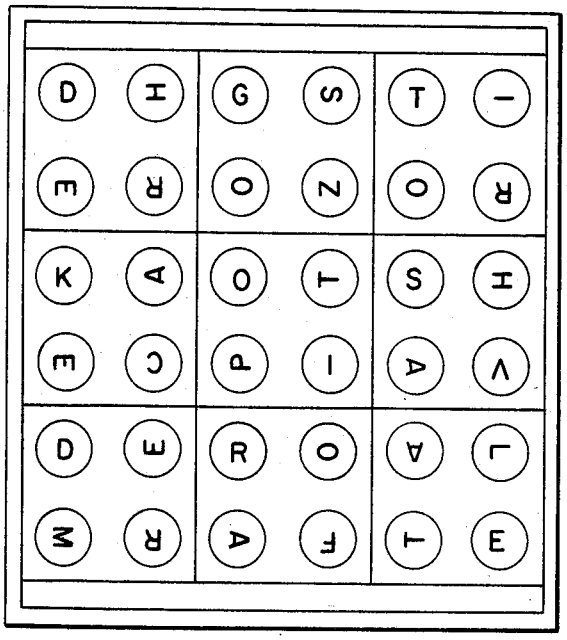
FIGS. 2 and 3 illustrate letter tiles selected for play and placed in the game tray in accordance with the first embodiment of the invention.
Figure 3:
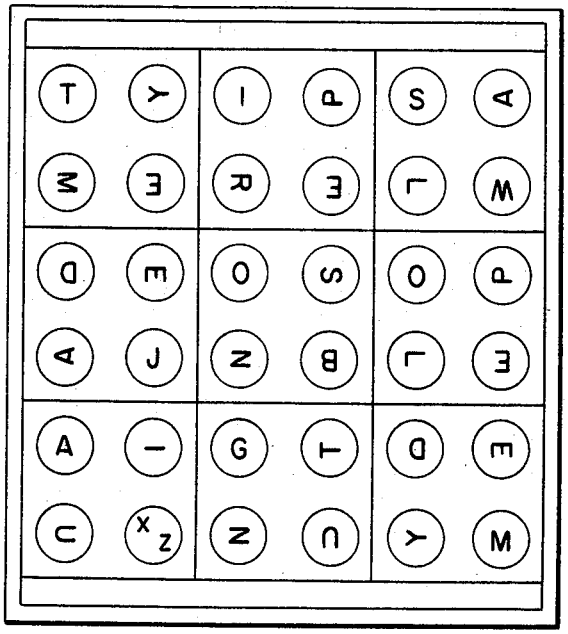

FIG. 2 illustrates the game tray with the game tiles placed therein to form an array for game playing, while FIG. 3 shows the letter tiles placed within the game tray to form a different array for game playing.

The embodiment of the invention shown in FIGS. 1–3 requires 18 letter tiles, 36 game playing rings and 1 game tray for playing. The object of the game in this embodiment is to form words from the letters in the game tray and claim the letter locations by surrounding them with the game playing rings.

The game is begun by turning the letter tiles face down and mixing them to produce a random array of letter tiles. One tile at a time is picked up and placed letter side up on the game tray until the game tray is filled with nine tiles. Unused tiles may then be placed off to the side for later game play. One player is assigned to, and associated with, the red side of the playing ring to indicate his claimed letters while the other player uses the blue side of the playing ring to indicate his claimed letters. The particular embodiment being described is intended for use with two game players.

Players alternate turns and on each turn a player forms a word from the array, or pool, or letters. A claim is made to each leter forming a word by placing a ring of his or her color orientation, (i.e., blue or red side of the ring) over the letter being used in word formation. Word formation requires that any letter of the word formed be connected to any of the adjacent letters either across, up, down or diagonally in any direction and occur in the order of the word formed. No one letter at any location may be used more than once in forming a word. After the first word is selected, word formation must adhere to the following two rules:

1. The player must use at least one as yet unclaimed letter in forming the word.
2. The player must use at least one already claimed letter in forming the word.

In forming a new word, if a player uses letters that have been previously claimed by his opponent, the rings surrounding those letters are flipped over. In this way, players can capture letters opponents have claimed and claim them as their own. However, claimed letters are always vulnerable to recapturing by an opponent. It is important to note that if in forming a word a player uses previously claimed letters of his own, the rings surrounding these letters are not flipped over.

Forming words solely from the four letters occupying a single tile is not permitted. Also, if a player is unable to form a word on his turn, he must capture any one unclaimed letter that is bordered by any other claimed letter to end his turn. Players continue to take turns until all 36 letters are claimed. The winner is the player who has claimed the most letters after all 36 letters have been ringed.

Due to the multiple state playing rings, each player can instantly determine his or her status in the game by simply viewing the board and counting the colors of the particular rings, which have claimed the various letters.

Figure 4:
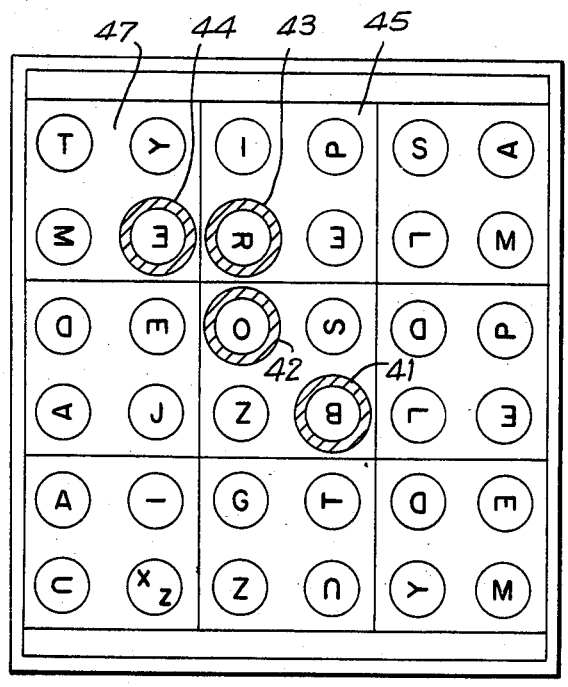
FIGS. 4 and 5 illustrate word formation by two opposing players during game play in the first embodiment of the invention.
Figure 5:
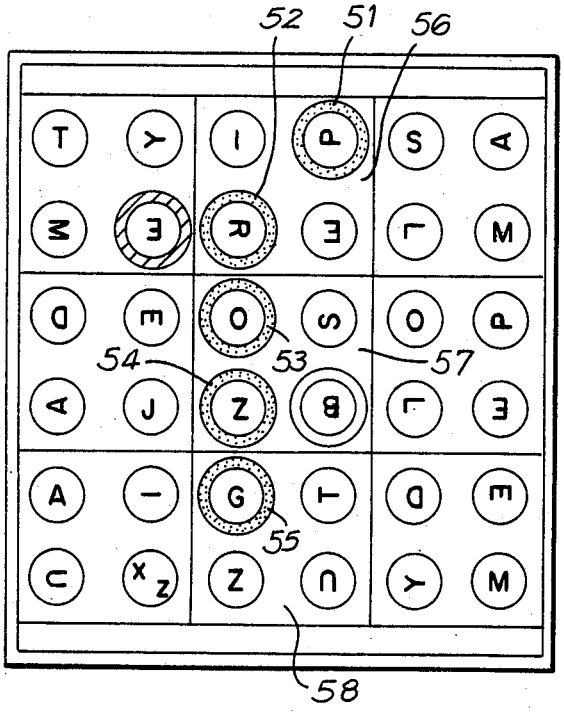

An example of game playing is illustrated in FIGS. 4 and 5. Note that in FIG. 4, the word "bore" has been formed by the blue player placing playing rings 41–42 over the letters B and O on letter tile 46, by placing playing ring 43 over the letter R in letter tile 45 and by placing playing ring 44 over the letter E in letter tile 47. In play, after this word was formed by the blue player, it would then be the red player's turn to form a different word. Referring now to FIG. 5, there is shown the result of the red player having formed the word "prong", by placing one red ring 51 over the letter P in letter tile 56, by flipping over the rings 52, 53 over the letters R and O in letter tiles 56 and 57 and by placing red playing rings 54, 55 on the letters N and G on tiles 57 and 58. Note that upon completion of his or her turn, the red player has formed a new word and has captured two letters from the blue player. At this point, therefore, the score would be red player five and blue player two.

Figure 6:
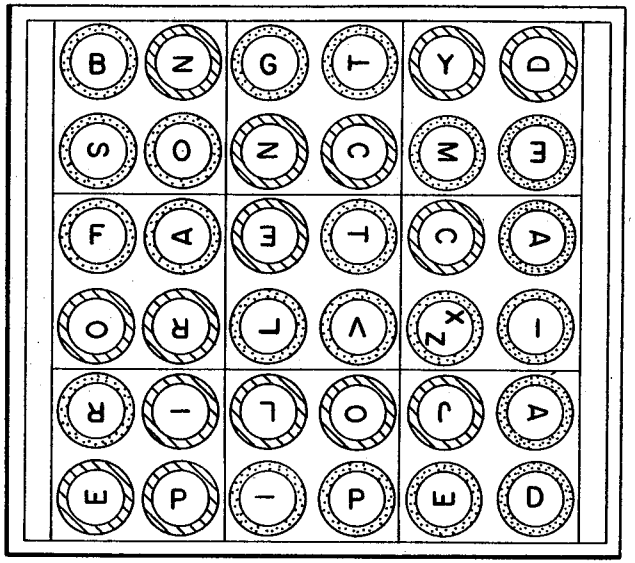
FIG. 6 illustrates game storage for the first embodiment of the invention.

FIG. 6 illustrates game storage with all letter tiles placed within the letter tray and all playing rings placed atop the letter tiles. In this configuration it can be readily seen that packaging and/or storage is readily accomplished.

The essential mechanism of the game of the instant invention is the capture of letter locations using a game piece that has the potential to indicate a dual or multiple state or condition. In the embodiment just described, the game playing piece was realized in a two player game as a condition ring with two different visually differentiated conditions, i.e. color. It is of course understood that the two conditions could be differentiated with different texture, raised numbers, various striping and so forth. The variable condition indicated, however, could also have more than two conditions which would then make possible a game for multiple players, e.g. more than two.

Figure 8:
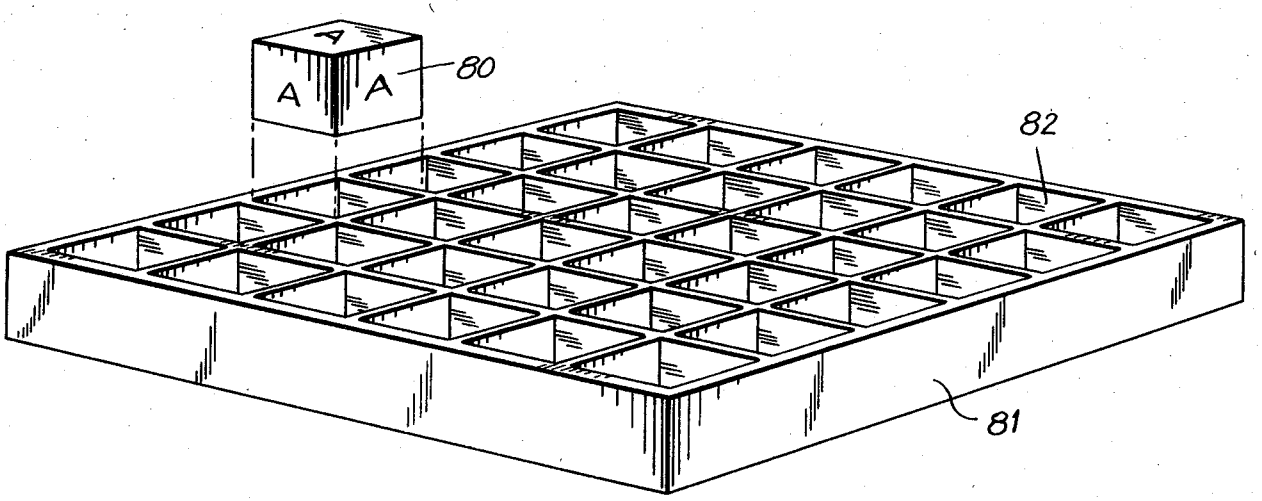
FIG. 8 illustrates a six-sided die and playing board for use with a second embodiment of the invention.

Referring now to FIG. 8 there is shown a second embodiment of the invention suitable for play by multiple players. FIG. 8 indicates a variable indicator player piece consisting of a six sided die 80. In this embodiment, the letter to be captured is integrated into the playing piece itself and displayed on all six sides of the die. On one of the sides the letter appears in a neutral condition, while on the remaining five sides the letter appears in differentiating conditions. Thus, referring to FIG. 8 and using colors, for example, one could have the specific letter appear in black as a neutral condition, and the other five sides have the same letter appearing as red, yellow, blue, green and orange. Alternatively, of course, letter differentiation could be accomplished with separate textures, various striping and so forth.

This embodiment of the invention utilizes playing board 81 shown in FIG. 8 which consists of 36 compartments 82 in a $6\times6$ array. The compartments are sized to receive the playing die. For this embodiment, at the start of the game, a die would be randomly drawn from a container and placed one at a time in the playing compartments with the neutral side, i.e., black leter side facing up. When all letter dice have been placed, there is a starting array on the playing board consisting of a $6\times6$ array of letters displayed, as in the two player ring version. Players then take turns forming words according to the rules stated above. As can be seen, a mechanism has been created whereby each player can capture any letter and identify it as his own by turning that letter die with his or her assigned colored letter designation facing up. As before, opponents capture letters by changing the color orientation of the letter die as required during word formation.

It should be noted that the game of the instant invention can be played with any x by y array of letters. In addition, the array could take any irregular shape as well as the rectangular shape described herein. Use of multiple sided die, e.g. tetrahedal, polygonal and so forth, as in the embodiment discussed with respect to FIG. 8, enables the game to be played by any number of players. Also, another two player version of the game is possible with a single two sided playing piece having a letter of one color on one side and the same letter of another color on the opposite side.

What has been described is a letter forming game in which capture of letter locations using a multiple condition game piece provides a game which is challenging, exciting and can be used with multiple players. Various embodiments of the invention are possible in addition to the two embodiments described herein.

It is understood that modifications may be made in the details and embodiments of the game described herein, without departing from the essential attributes of the invention and all such changes and variations are contemplated as coming within the scope of the appended claims.

I claim:

1. Game playing apparatus for two or more game players, comprising, a plurality of individual letters arranged as a letter array, means operable by each of said game players for forming, into words, individual letters from said letter array, means for associating letters comprising a particular word formed, with the game player forming said particular word, and means for changing a first association of a predetermined group of letters with a first player, to association of said predetermined group of letters with a second player, said changing means operative during word formation by said second player.

2. Game playing apparatus in accordance with claim 1 wherein said letter array comprises a plurality of letter tiles, each of said letter tiles bearing a predetermined number of raised individual letters.

3. Game playing apparatus in accordance with claim 2, wherein said forming and associating means includes a dual colored playing ring, each of said colors on said playing ring being assigned to a particular game player and said playing ring being appropriately sized so as to fit over said raised letters on said letter tiles, whereby words are formed by placing said playing rings over selected letters on said letter tiles.

4. Game playing apparatus in accordance with claim 3 wherein said changing means includes said dual colored playing ring having a first color assigned to a first player on a first ring surface and a second color assigned to a second player on a second ring surface, whereby during word formation said dual colored playing ring is flipped to expose said second surface and conceal said first surface, thereby changing the association of a particular letter with a particular player.

5. Game playing apparatus for two or more game players, comprising, a plurality of individual letters arranged as a letter array, means operable by each of said game players for forming individual letters from said letter array into words, means for associating letters comprising a particular word formed with the game player forming said particular word, and means for capturing, during word formation, letters associated with an opposing game player.

6. Game playing apparatus in accordance with claim 5 wherein sid letter array comprises a plurality of multiple sided dice with each die having a plurality of faces and each face bearing a single letter, said die being inserted into a game board to form said letter array.

7. Game playing apparatus in accordance with claim 6 wherein said forming and associating means includes said multiple sided die having a different color on each face thereof, each of said colors on each of said faces being assigned to a particular game player and selected ones of said die faces being arranged to form words.

8. Game playing apparatus in accordance with claim 7 wherein said capturing means includes said multiple-sided die having the same letter on each die face and having each color on each die face associated with a different player, whereby during word formation said die is flipped to expose the color associated with the player forming said word being formed.

9. A word forming game for a plurality of game players, comprising a plurality of letter dice, each of said letter dice having a plurality of faces and bearing a first predetermined number of letters on each of said faces, a game tray into which a predetermined number of said letter dice are inserted so that a letter bearing face is visible and means for associating particular die faces with a particular game player.

10. A word forming game in accordance with claim 9, wherein said dice have six faces, the same letter being on each face and each face being of a different color, one of said colors being a neutral color and the remaining colors being assigned to different game players.

* * * * *